US005408778A

United States Patent [19]

Goodwin et al.

[11] Patent Number: 5,408,778

[45] Date of Patent: Apr. 25, 1995

[54] EXTENDED-RANGE GUN SIGHT MOUNTING SYSTEM

[75] Inventors: David H. Goodwin, Hollis; Kevin M. Sullivan, Kennebunk; Steven F. Wilson, Biddeford, all of Me.

[73] Assignee: Saco Defense Inc., Saco, Me.

[21] Appl. No.: 134,973

[22] Filed: Oct. 12, 1993

[51] Int. Cl.[6] ..... F41G 1/46

[52] U.S. Cl. ..... 42/100; 33/259; 89/41.190

[58] Field of Search ..... 89/41.17, 41.19, 41.01; 42/100; 33/259, 260, 235; 235/418

[56] References Cited

U.S. PATENT DOCUMENTS

| | | | |
|---|---|---|---|
| 1,340,453 | 5/1920 | Lera | 42/100 |
| 1,684,825 | 9/1928 | Henderson | 89/41.19 |
| 1,695,483 | 12/1928 | Dawson et al. | 89/41.19 |
| 3,516,168 | 6/1970 | Asikainen | 33/235 |

*Primary Examiner*—David Brown
*Attorney, Agent, or Firm*—William Nitkin

[57] ABSTRACT

A gun sight mount used in association with a gun barrel, such gun sight mount positioned on a axially rotatable shaft member disposed at an acute angle to the axis of the gun barrel, offsetting such sight mount to a side of such gun barrel. A handle causes rotation of the shaft member and sight mount such that the sight mount moves from a position where its axis is parallel to the axis of the gun barrel to a position where its axis is pointing downward and outward from the direction of the axis of the gun barrel to a point selected for the desired range whence the sight is then aimed at the target which action then elevates the gun barrel for the correct range and offsets the gun barrel from the target to adjust for the projectile's drift in order to aim the projectile accurately to hit the target.

12 Claims, 8 Drawing Sheets

FIG. 11
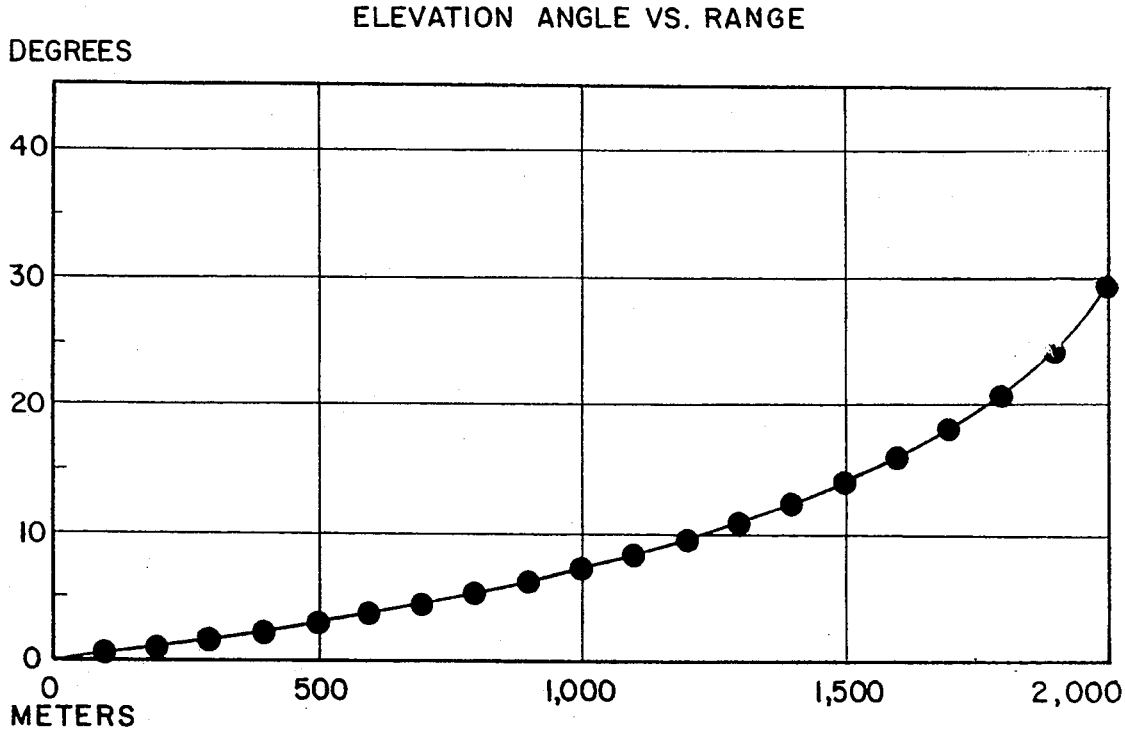
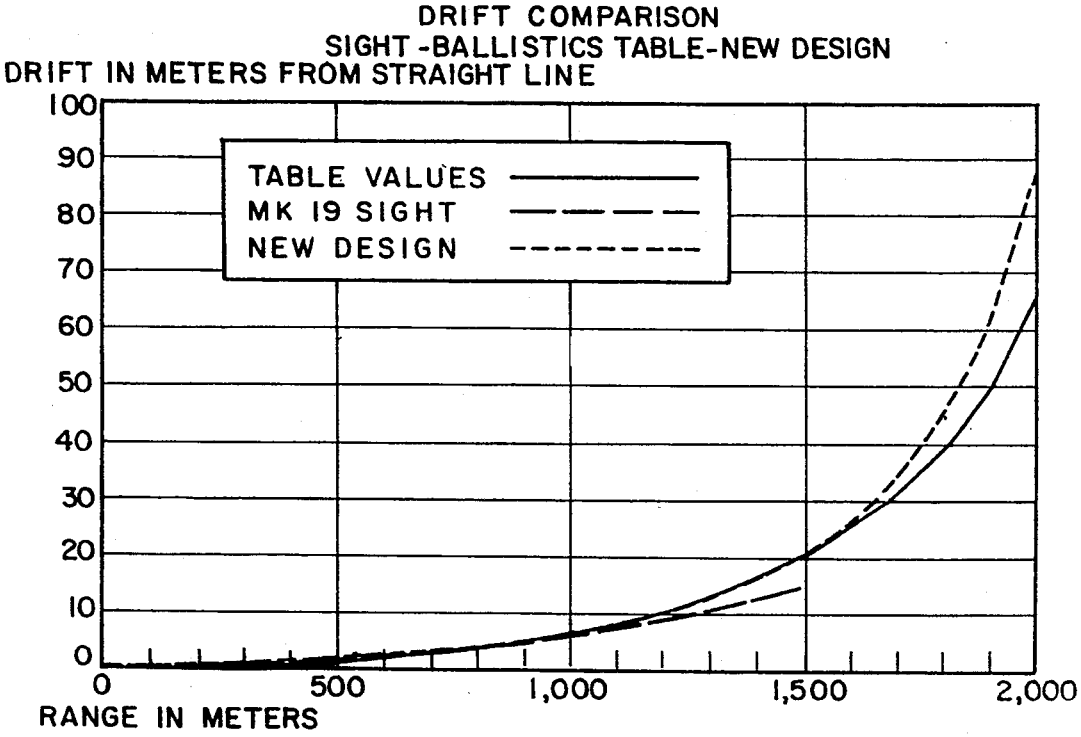
FIG. 10

EXTENDED-RANGE GUN SIGHT MOUNTING SYSTEM

BACKGROUND OF THE INVENTION

1. Field of the Invention

The invention herein resides in the area of gun sight mounts and more particularly relates to an off-barrel gun sight mount that can be manually adjusted for both range and projectile drift.

2. Description of the Prior Art

MK19 heavy grenade machine guns currently incorporate a fold-up, rear iron sight mounted on the rear of the receiver which sight is utilized in combination with a fixed front sight post mounted at the weapon's midsection at the juncture of the rear of the barrel and the front of the receiver. The current iron sight is adjusted for ranges beyond 300 meters by manually raising its "ladder" member to the desired range marked on its vertical scale which action causes a laterally sliding of an open notch member on the "ladder" member. The open notch is then aligned with the front sight post, and the gun is targeted by the manual manipulation of the weapon. Because of the very high trajectory of 40 mm ammunition at ranges beyond 1500 meters, the barrel of the gun must be elevated considerably; and at distances beyond 1500 meters the end of the barrel obscures the front sight post since it extends upwards in front of the sight post and thus prevents the gunner from sighting with the prior art fold-up iron sight. Since the effective range of the ammunition for the MK19 heavy grenade machine gun is greater than 2000 meters, an improved sight has long been felt desirable for the MK19 heavy grenade machine gun and equivalent guns. Merely extending the height of the "ladder" of the iron sight currently used would not solve the above-mentioned problems since the front sight post is mounted at the weapon's midsection and would have to be relocated to the muzzle end of the barrel. Such movement of the front sight post to the muzzle end of the barrel is impractical since there is no accurate top dead center reference surface, and such movement would further require regraduation and replacement of the current rear iron sight.

Many other different types of sights can also be mounted on MK19 machine guns on a fixed-sight mount placed on the receiver of the gun with such sights directly above and in line with the barrel axis, such as day-night sights, image-intensifier sights, thermal sights, and laser-aiming devices in combination with image-intensifier sights, but these sights, being aligned with the barrel, are also interfered with by the elevation of the barrel at extended ranges and have no effective way for being adjusted for elevation relative to range. Some sights have graduation lines in their eyepieces to indicate various ranges.

Improving the ability of the MK19 heavy grenade machine gun to be properly aimed beyond 1500 meters would significantly enhance its tactical flexibility and provide greater depth of usage in a variety of situations for defensive and offensive operations, resulting in enhanced effectiveness of the crew and weapon.

SUMMARY OF THE INVENTION

It is an object of this invention to provide a significantly improved, full-range sight mount suitable for use on the 40 mm MK19 heavy grenade machine gun. Guns having similar physical structures to the MK19 heavy grenade machine gun can also benefit from the gun sight mounting system of this invention.

It is a further object of this invention to be able to support on its mount a variety of different types of sights, such sights being well known in the prior art.

The sight mount of this invention in one embodiment can be mounted on the rear top of the machine gun's receiver and offsets the sight mount and sight(s) from any direct alignment above the barrel by a system which allows such sight mount to be aligned with the line of fire but yet displaces such sight mount from any alignment directly above the axis of the barrel. The sight mount can be mounted elsewhere on the gun. A self-luminous sight adjustment lever is provided which is easily adjustable by a crew even under low-light level conditions. Day-night sights, image-intensifying sights, thermal sights, laser-aiming devices with image-intensifiers, laser range finders, or other types of sights can be built into or mounted on the sight mount of this invention without limiting the effectiveness of the gun when fired at its maximum range because the elevated gun barrel no longer blocks the sight being used, as occurs in the prior art, which feature also allows the gunner unfettered access to the ammunition supply feed cover and breech area.

It is yet a further object of the mounting system of this invention to provide a repeatable, pre-zeroed mounting of the sight mount on the receiver of the gun on which it is utilized and to allow an MK19 heavy grenade machine gun to be utilized at its maximum potential effective range, thereby enhancing its tactical flexibilty for use in the battlefield. The mounting system of this invention allows for repeated mounting and dismounting of the sight mount from the receiver of the weapon without changing the zeroed-in aiming effect of the weapon. The use of the sight mount of this invention can replace prior art iron sight systems or can be utilized in addition to prior art iron sights. The sight mount also can include an iron sight which in one embodiment can be a tubular aperture in its structure, forming a built-in iron sight which can be used by itself without the necessity of mounting any other type of Sighting system thereon. Other types of iron sights can be used on the sight mount other than the tubular sight illustrated. The sight mount of this invention fits on a saddle mount which is positioned on the top rear of the receiver. The sight mount attaches by a 3-point attachment system so that it is repeatably attachable in the exact same position by such quick disconnect system. The mounting system receptacle and interface members use V-shaped surfaces in all three planes to provide repeatable relocating of the sight mount platform each time that it is removed.

The extended-range sight mount of this invention has been created to allow any sighting device(s) mounted thereon to be aimed at the target with the barrel of the weapon able to be elevated to the elevation necessary to hit the target with such sight(s) not interfered with by the elevated barrel. Once the distance to a target is determined which information is normally gained by consulting maps, by visual estimation or by use of laser measuring devices, two other pieces of information are needed for proper aiming of the barrel: one is the correct elevation of the barrel which can be determined by consulting relevant charts and which feature is incorporated in the sight system, and the second is the degree of barrel lateral offset required to adjust for the drift of the projectile during its flight. The projectile, because of its spin, drifts to the right further and further due to precession caused by aerodynamic pressures as it proceeds toward the target. The degree of drift adjustment is well known along with the elevation of the barrel necessary to properly aim the projectile at the desired target.

The sight mount of this invention provides a platform on which a plurality of sight mounts of existing sighting systems, such as the previously mentioned day-night sights, thermal sights, image-intensifier sights, laser-aiming devices and the like, can be mounted. Such sights are well known in the prior art and have standardized mounting bases which can be attached to the sight mount platform used in this invention. The sight mount of this invention is provided with an external handle having range settings which handle is manipulated by a crew member operating the machine gun. The handle can be simply rotated to a setting indicating the desired range for firing, and such handle causes a shaft to which the sight mount platform is attached to be rotated. This shaft is rotated by a cam follower which is attached to one end of the shaft and is moved by a rotating eccentric cam. The cam is rotated by the manually operated handle. The other end of the shaft supports and moves the sight mount platform. The shaft is disposed at an angle transverse to the gun barrel but is not perpendicular to such barrel. The angle at which the shaft is disposed to the MK19 gun barrel is approximately 70 degrees. The angle of the shaft to the axis of such gun barrel is chosen such that if the gun barrel is first parallel to the sight on the sight mount platform at a setting of zero, then as the shaft rotating the sight mount platform rotates by the action of the handle moving the cam which then moves the cam follower mounted on the end of the shaft, such sighting system's sight mount platform simultaneously rotates downward a distance depending on the desired range and also moves out of parallel alignment with the axis of the gun barrel to an angle to the axis of the gun barrel which corresponds to the anticipated extent of drift of the projectile at such range. The angle of the shaft that crosses the axis of the barrel is chosen to minimize the drift error of the projectile as defined in the gun's ballistic tables. While any of the various sighting systems, as described above, can be mounted thereon, the built-in, internal iron sight formed within the sight mount platform can be used alone or used so that any mounted sight could be calibrated to such internal sight. The internal iron sight within the sight mount platform is preset when the sighting system is aimed parallel to the barrel axis at a zero setting to be aligned with the barrel bore's center line.

Other features of the sight mounting system include having the handle of the sight mount have illuminated markings indicating range for use at night with a built-in clicking detent plunger to provide audible and/or tactile indications of range setting. Further, the handle can have one or more surfaces that become parallel with fixed pieces of the housing to provide additional, non-visual indications of range setting to the crew. The device also can have a range lock to prevent the shaft from rotating inadvertently or disengaging from the range setting during firing of the machine gun.

BRIEF DESCRIPTION OF THE DRAWINGS

FIG. 10 shows a ballistic table showing accuracy of an MK19 machine gun incorporating the sight mount of this invention in comparison with the accuracy of the same machine gun utilizing the prior art iron sight and the theoretical drift of the projectiles fired.

FIG. 11 illustrates a chart showing the elevation angle of the gun's barrel required to achieve desired ranges of a target.

DESCRIPTION OF THE PREFERRED EMBODIMENT(S)

Figure 1:
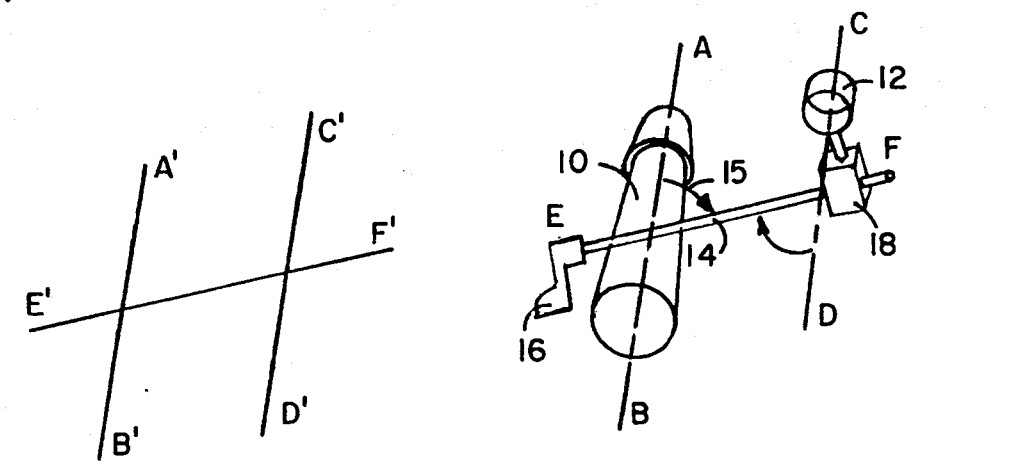
FIG. 1 illustrates a diagrammatic perspective rear view of an MK19 machine gun barrel disposed parallel to the sight mount of this invention with shaft to barrel/sight angles shown therebeside.
Figure 2:
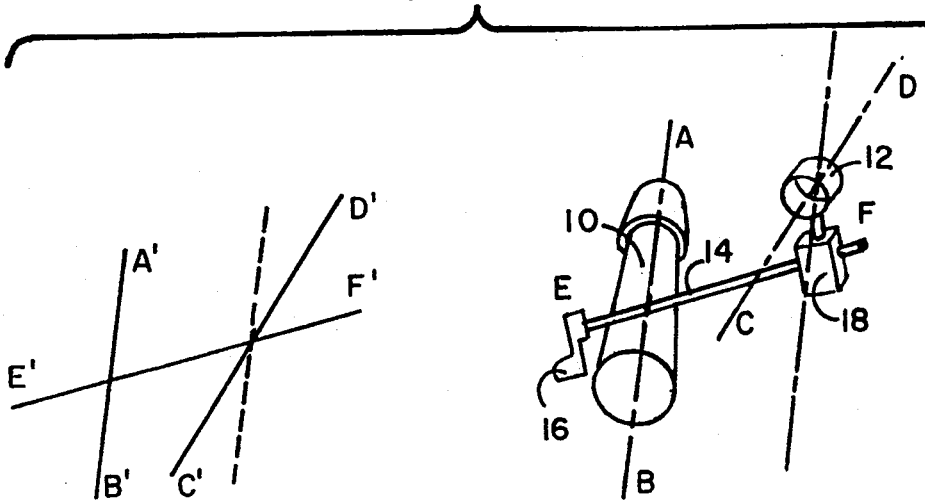
FIG. 2 illustrates a diagrammatic view of FIG. 1 with the sight mount having been rotated to be set for a desired range distance, showing the now non-parallel alignment of the barrel and sight mount axes with barrel/sight angles shown therebeside.
Figure 3:
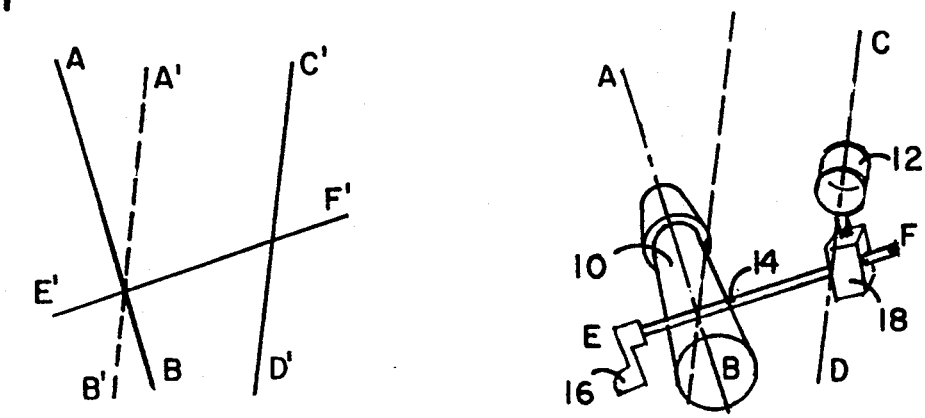
FIG. 3 illustrates a diagrammatic view of FIG. 2 where the sight mount, once set, has been aimed at the target which action repositions the barrel of the gun with barrel/sight angles shown therebeside.

FIG. 1 illustrates a diagram showing the positioning of the main components of this invention. Shaft 14 is positioned transverse to gun barrel 10 but not perpendicular to it. Sight mount 18 is disposed at first end of shaft 14 which is seen positioned at an angle 15 of approximately 70 degrees to axis A–B of barrel 10. Shaft 14 can be rotated at its second end by rotation of handle 16 as described below. In its zero position shaft 14 aligns sight mount 18 such that sight 12 is parallel through its axis C–D with axis A–B of barrel 10. In order to aim the gun, one first adjusts handle 16 to a rotation setting for the desired range of the target that one wishes the fired round to hit. The handle rotates a mechanism described below which rotates shaft 14 which in turn angularly rotates sight mount 18 downward so that axis C–D of the sight mount is no longer in parallel alignment with axis A–B of barrel 10. This rotational movement of the shaft, as illustrated in FIG. 2, causes the sight mount and attached sight to be aimed somewhat downward and to the right of barrel 10 so that axis C–D of sight 12 is now at a downward and outward angle from axis A–B of barrel 10. This angular movement away from the parallel alignment with axis A–B of barrel 10 as the handle is rotated is the feature that corrects for the projectile drift, and the angle of axis C–D away from being parallel with axis A–B is determined by angle 15 to which shaft 14 is disposed to axis A–B of barrel 10. An angle of approximately 70 degrees has been found to work satisfactorily. Once the desired range has been set on handle 16, one manipulates the gun to aim sight 12 directly on the target. This aiming of sight 12 on the target then causes barrel 10, in the case illustrated, to be both elevated and moved so that its axis A–B is no longer in its original position but is offset an angle toward the left of its original position, as seen in FIG. 3. This angular positioning and raising of the barrel causes the barrel to be both elevated for the proper range and offset from its original position to account for projectile drift. If horizontal planes were drawn through the axis of the barrel and the sight mount when the sight mount is set for a distance, the sight mount's horizontal plane would move downward to form an acute angle to the horizontal plane of the barrel. If at the same time there were perpendicular planes drawn through the barrel and the sight mount, they would be initially parallel at zero range but as the sight mount was rotated downward to be set for a distance, the perpendicular plane through the axis of the sight mount would then be moved to intersect the perpendicular plane of the axis of the gun barrel toward the rear of the gun forming also a changing acute angle as the sight mount was rotated downward. Calculations for various gun projectiles for many types of guns can be made by analysis of each type of projectile's drift curve and selection of a shaft-to-gun barrel angle that best provides a match of the outward angular movement of the sight mount to the actual projectile drift. Some shaft-to-gun barrel angles will yield greater close range accuracy while others will yield greater mid-range accuracy while others will yield a more distant range accuracy. The selected angle is chosen by the preference to which range the most accurate drift correction is desired. Therefore the basic structure of this invention with the shaft disposed at an angle to the axis of the barrel and transverse thereto allows for the aiming of the gun to account for both projectile drift and desired range while no longer requiring that the sight mount for such gun be positioned directly over the barrel of the gun. The offset sighting mount of this invention solves the problems described above in the prior art yet allows for accurate aiming at ranges beyond what is currently possible with the prior art iron sight which is interfered with by the elevated barrel as described above. In accomplishing the features of this invention, the angle of shaft 14 to the axis of the barrel must be determined in relationship to the amount of drift of projectiles fired. Table 1 below shows the drift by distance for 40 mm projectiles of an MK19 heavy grenade machine gun along with the degree of barrel elevation necessary to achieve the desired range.

TABLE 1

| RANGE (meters) | BARREL ELEVATION (mils) | DRIFT (mils) |
|---|---|---|
| 0 | 0.0 | 0.0 |
| 100 | 8.9 | 0.4 |
| 200 | 18.6 | 0.8 |
| 300 | 28.9 | 1.3 |
| 400 | 40.1 | 1.8 |
| 500 | 52.1 | 2.4 |
| 600 | 65.1 | 3.0 |
| 700 | 79.2 | 3.7 |
| 800 | 94.5 | 4.5 |
| 900 | 111.2 | 5.4 |
| 1000 | 129.3 | 6.3 |
| 1100 | 149.2 | 7.4 |
| 1200 | 171.1 | 8.7 |
| 1300 | 195.2 | 10.1 |
| 1400 | 222.2 | 11.7 |
| 1500 | 252.4 | 13.6 |
| 1600 | 286.8 | 15.8 |
| 1700 | 326.7 | 18.4 |

TABLE 1-continued

| RANGE (meters) | BARREL ELEVATION (mils) | DRIFT (mils) |
|---|---|---|
| 1800 | 374.5 | 21.7 |
| 1900 | 435.3 | 26.1 |
| 2000 | 525.1 | 33.1 |
| 2057 | 666.6 | 46.1 |

For other weapons such shaft angle would have to be determined depending upon the ballistic values, drift of the projectiles and the elevation necessary to achieve the desired range so that the sight mount of this invention can be adapted according to such computation for use on a variety of guns.

Figure 4:
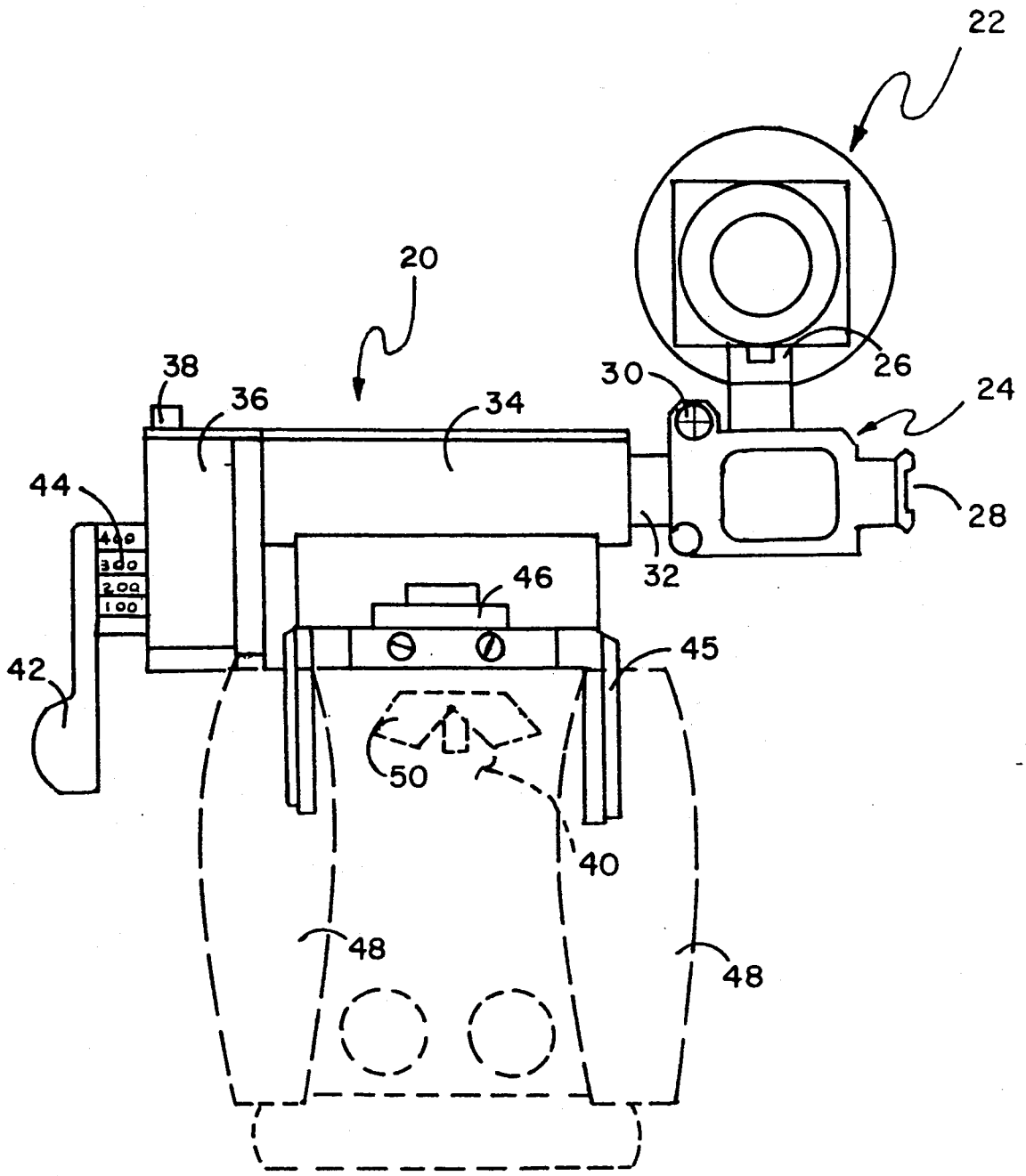
FIG. 4 illustrates a rear view of the sight mount of this invention mounted upon a machine gun.

FIG. 4 illustrates a rear view of the sight mount of this inventions mounted upon a machine gun such as an MK19 heavy grenade machine gun. Shown in dashed lines in this view are dual handles 48 with saddle mount 45 straddling the top of receiver 40 of the gun. On saddle mount 45 is a quick disconnect member 46, which will be described in further detail below, above which is positioned shaft housing 34 through which the angled shaft, not seen in this view, is disposed. At one end of the angled shaft is range lever 42 which rotates range indicator 44 and a cam member housed within cam housing 36. The cam member rotates against a follower, as will be described further below, mounted on the end of the shaft which in turn rotates sight mount support 32 in the directions as described above. Sight mount platform 24 can have a built-in, iron sight such as tubular sight 30 and a plurality of sight mounts such as upper sight mount 26 and lower sight mount 28 on which sight mounts, such as day-night sight 22, can be mounted in the traditional way. Sight assembly 20 is easily demountable and can be locked in its range set position by range lock switch 38, as will be described further below, so that once set, the sight mount cannot be jarred loose from its locked position during firing of the gun.

Figure 5:
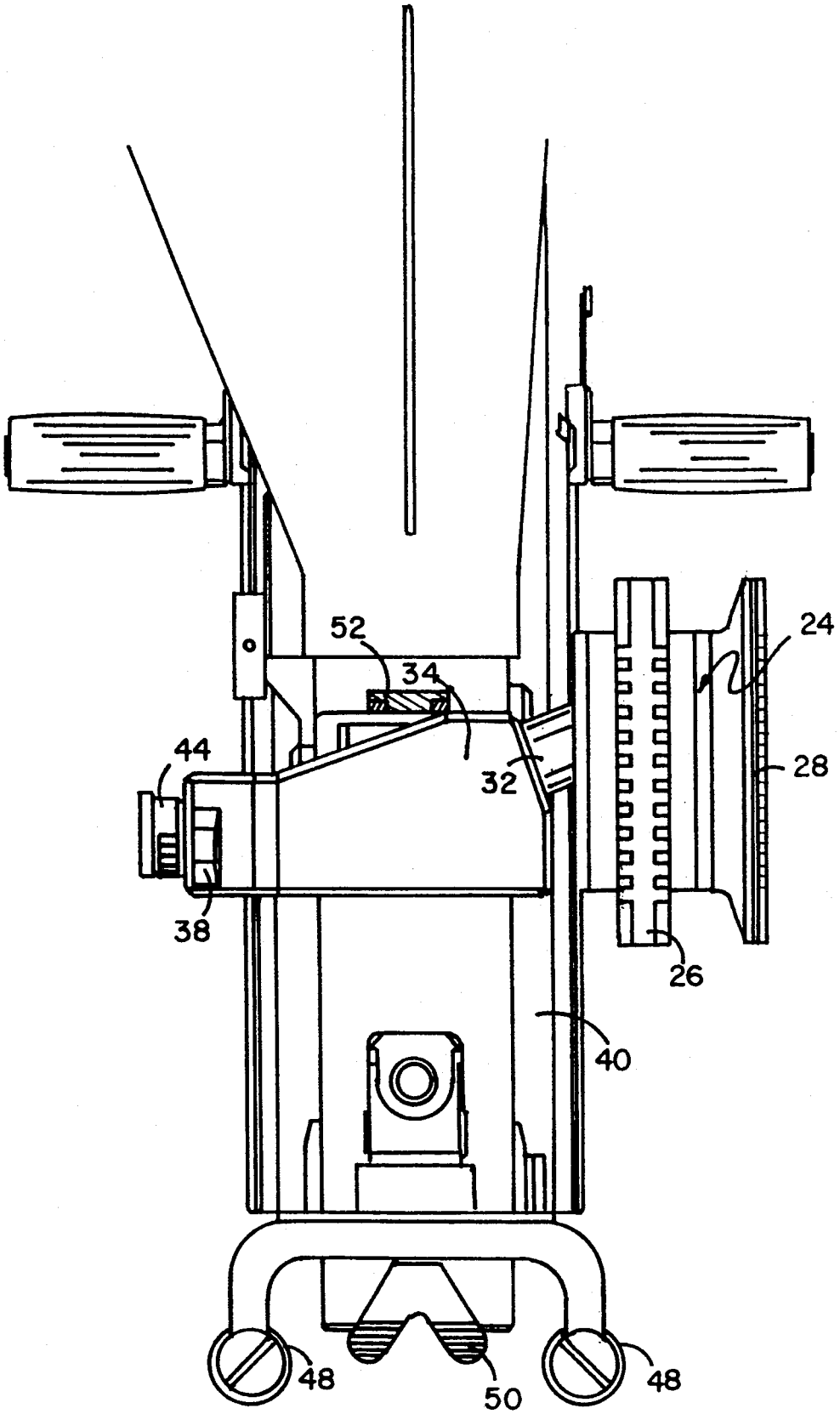
FIG. 5 illustrates a top view of the sight mount of this invention mounted upon a gun with the sight mount platform disposed parallel to the barrel of the gun.

FIG. 5 illustrates a top view of the sight mount of this invention mounted on a gun, showing some of the features of FIG. 4 with range indicator 44 visible along with range lock switch 38 which can lock a detent plunger in an advanced position protruding into a wheel member, as will be described further below, which range lock switch 38 is positioned on the top of shaft housing 34. Sight mount support 32 and sight mount platform 24 can be rotated downward and back upwards and both in and out of parallel alignment with the axis A–B of the barrel of the weapon, not seen in this view, but which is generally vertically aligned with receiver 40.

Figure 6:
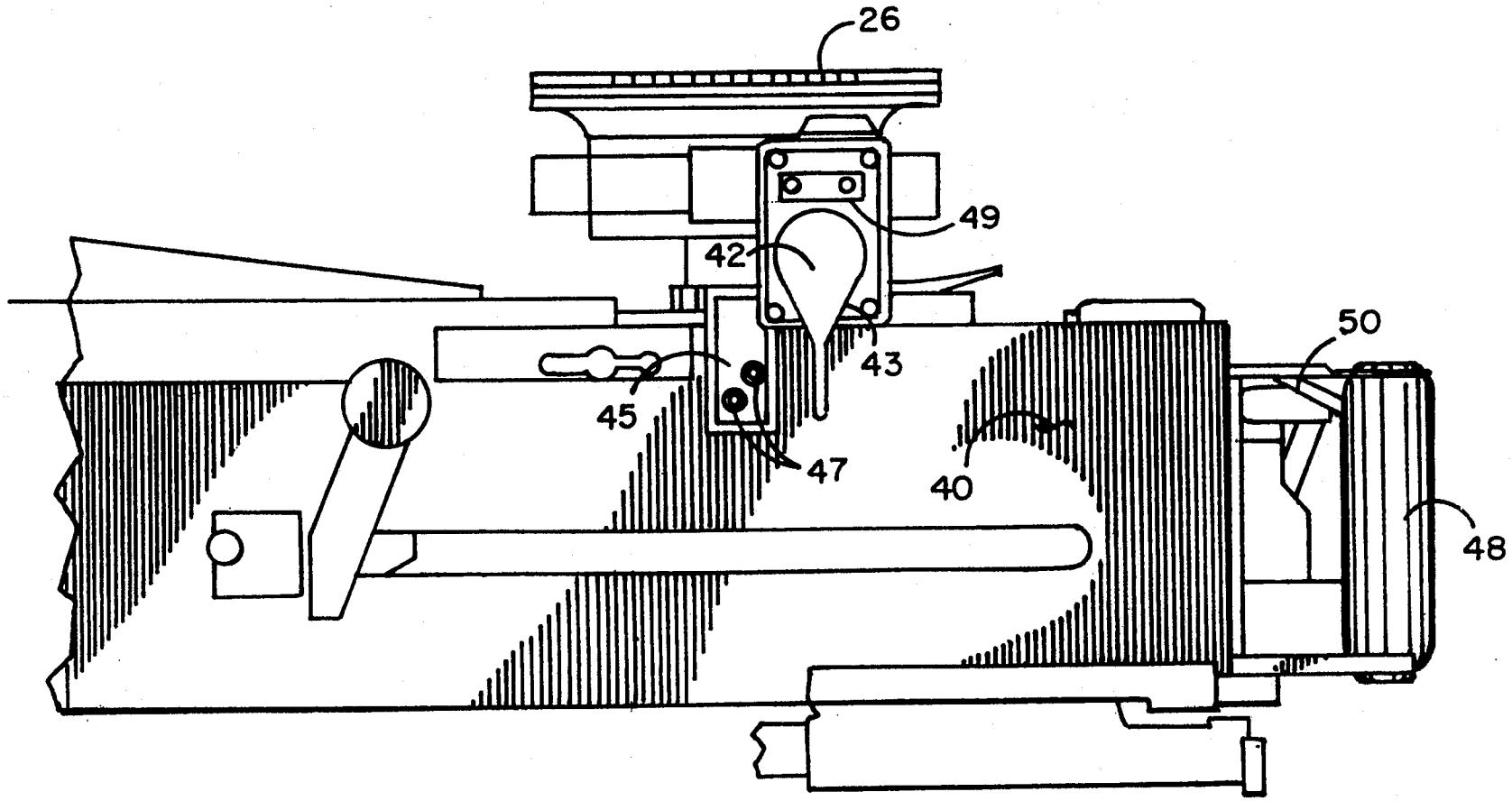
FIG. 6 illustrates a side view of the sight mount of this invention mounted on the top of the receiver of a gun.

FIG. 6 illustrates a side view of the embodiment of FIG. 4 further showing range lever 42 which is used to set the range and cause rotation of the sight mount platform 24. Upper sight mount 26 is seen in this view on which many types of well-known sights can be mounted. Saddle mount 45 straddles receiver 40 and is held thereto by a series of interlocking bolt members 47 or equivalent means of attachment passing into the receiver in an exact registration so that the sight mount of this invention can be repeatably engaged and disengaged therefrom as desired. A flat portion of range lever 42, being range lever index 43, is designed at a range of 1000 meters for the MK-19 to become parallel to index alignment member 49 so that a user can sense such range visually and/or by tactile sensation and can then pick out other ranges by estimation of movement of the range lever. Such a range indicator can be preset for other ranges and used with the sight mount of this invention on other types of guns.

Figure 7:
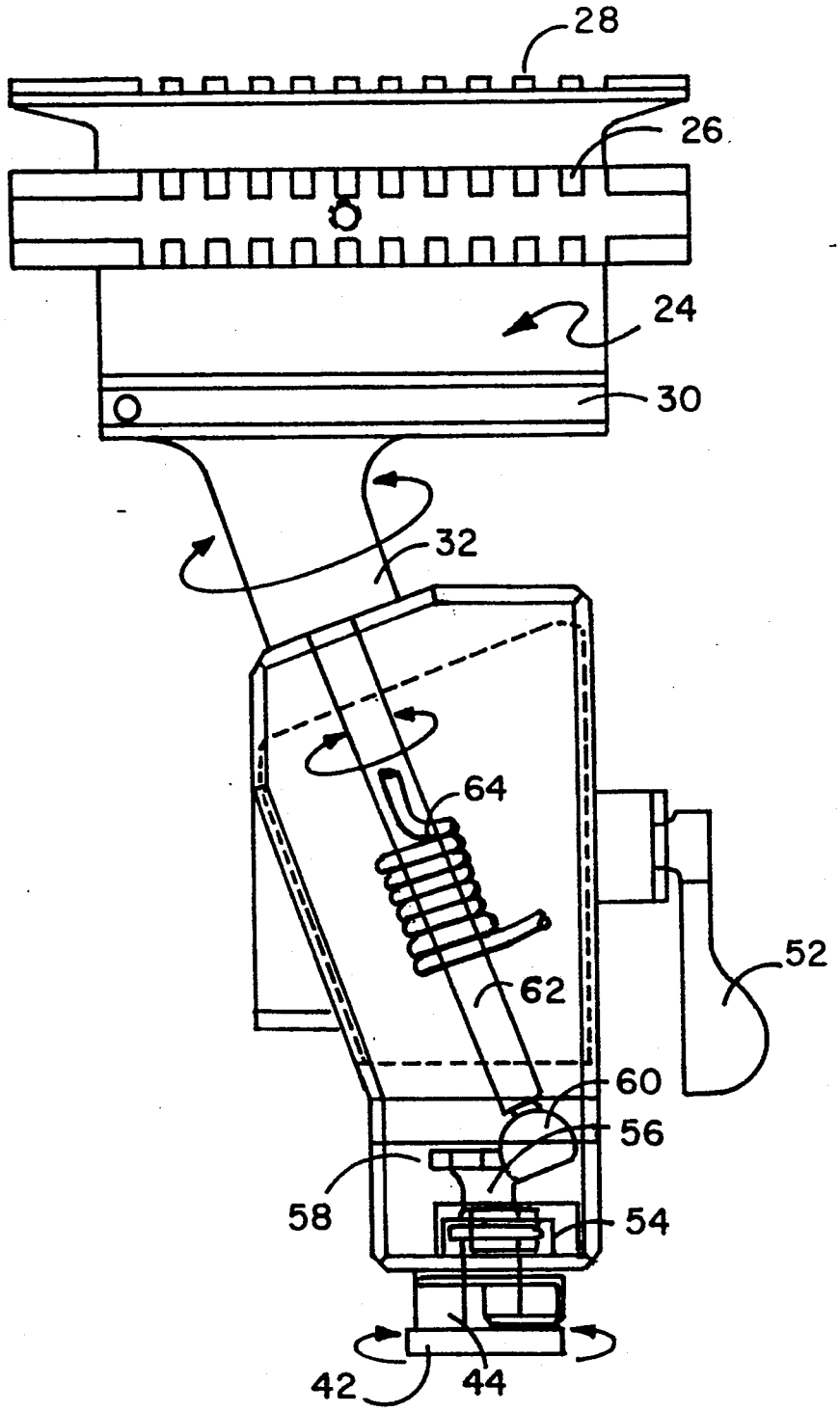
FIG. 7 illustrates a top view of the sight mount of this invention showing the internal structures thereof.

FIG. 7 illustrates a top view of the internal structure of the sight mount of this invention wherein range lever 42, aimed downward in this view, rotates range indicator 44 which can have imprinted thereon a plurality of ranges set out in meters which, in turn, rotates shaft 56 on which is positioned detent wheel 54. Detent wheel 54, in turn, rotates as does cam 68 further along shaft 56. Cam 58, rotated by cam shaft 56, then turns cam follower 60 mounted on shaft 62, causing shaft 62 which is rotatably held in housing 34, to rotate. Torsion spring 64 provides spring pressure resistant to such rotation so that the weight of the sight mount platform and sight mounts mounted thereon does not cause any inadvertent and unwanted rotation and the only rotation that occurs is caused by the movement of cam follower 60 by the action of cam 58 thereon while torsion spring 64 urges the cam follower securely against cam 58. Shaft 62 is securely connected to sight mount support 32 which rotates as seen by the arrows at the end of housing 34, not seen in this view, and causes the sight mount platform 24 and sight mounts thereon to be rotated downward and at an angle with the front of the sight mount then pointing somewhat away from its original parallel alignment with the barrel, as seen in FIG. 1, such that it is disposed, when placed at a distant range, at an angle such as illustrated in FIG. 2 in relation to the axis A–B of the barrel. The sight mounting structures, being upper sight mount 26 and lower sight mount 28, are of standard configuration in the art for the mounting of a variety of sight members thereon. Built-in iron sight such as tubular sight 30, as seen in FIG. 7, can be used even if no other sight is mounted thereon. Built-in sight 30 can be, in one embodiment as illustrated, a hollow tube formed within sight mount platform 24 and can have a cross hair thereon or other means for accurate sighting. Built-in sight 30 allows for the visual sighting through its elongated tubular aperture at the target. After the range has been determined and set on the range indicator, the entire gun can then be aimed by first manipulating the gun to aim the sight on the target, causing the barrel of the gun to be both elevated and angularly displaced to account for both the range and the drift of the fired round.

Figure 8:
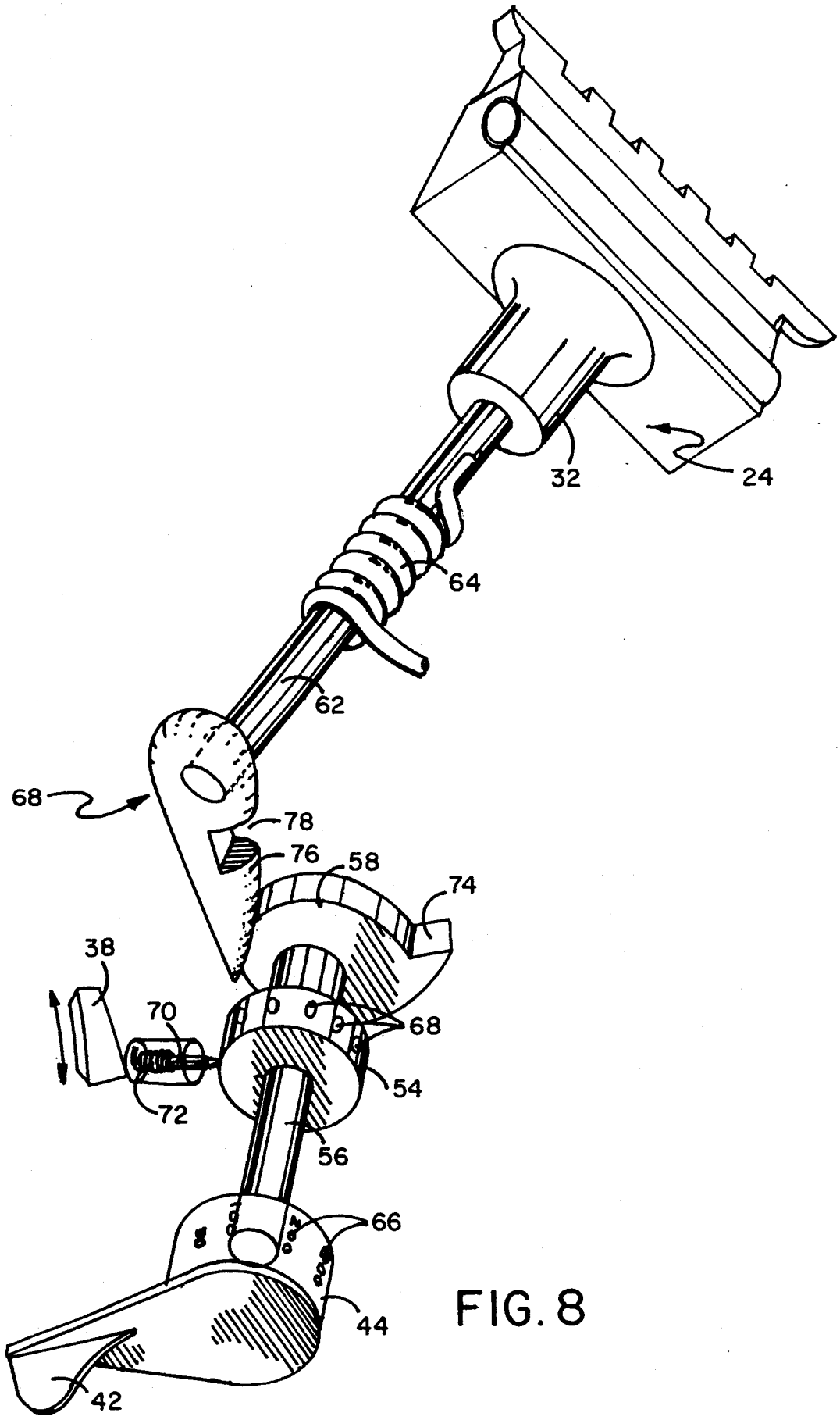
FIG. 8 is an exploded view of the internal structures of the sight mount of this invention operating in conjunction with one another.

FIG. 8 illustrates in further detail the structural components of the sight mount of this invention shown separated from their housings. Seen in this view is range lever 42 which rotates range indicator 44 which has imprinted thereon range settings 66 which can be in meters. Range lever 42 rotates a cam shaft 56 on which is positioned detent wheel 54 which has a plurality of small detents 68 defined therein which are spaced apart from one another, corresponding to the range distance settings 66 on range indicator 44. Plunger 70 is urged by plunger spring 72 to click into such detents so that even if one is not able to see the range distance settings on range indicator 44, one can hear and feel the clicking of the plunger into the detents to determine the range, each detent representing a 100-meter increment. Range lock switch 38, when pushed laterally on cam housing 36 has its bottom formed at an angle and in the position shown contacts and is engaged immediately behind plunger 70, thereby pushing thereon and holding plunger 70 in a selected detent 68 so that detent wheel 54 cannot rotate further until range lock switch 38 is moved laterally out of contact with its narrow end over plunger 70 which will not contact such plunger, allowing its upward movement urged by movement of wheel 54 placing a non-detented portion of detent wheel 54 thereunder such that plunger 70 is released as range lock switch 38 is moved away from the outer end of plunger 70 which released position feature is not seen in this view. Cam shaft 56 continues to cam 58 which rotates against cam follower 60. The base of cam follower 60 has a rounded contact surface 76 as it is being driven at an angle to cam 58, and various portions of the contact surface of the cam follower will be aligned on the surface of cam 58 as cam 58 rotates to various positions. An aperture 78 in rounded contact surface 76 allows for cam projection 74 to be engaged thereinto at the zero-most point of travel. Cam projection 74 is necessary in order to rotate cam follower 60 a further distance when cam projection 74 is positioned so as to be positioned under cam follower 60, moving cam follower 60 furthest away from its zero alignment position. This movement of cam 58 against cam follower 60 causes the rotation of shaft 62. Force is exerted counter to the rotation of shaft 62 by the urging of torsion spring 64 which is attached to shaft housing 34 and shaft 62 as seen in FIG. 7. Torsion spring 64 also serves to prevent any free rotation of the sight mount platform 24 during firing. Shaft 62 rotates sight mount support 32 and attached sight mount platform 24 both downward and at an outward angle so that when the gun is lifted to align the sight onto the target, such action causes the barrel of the gun to be lifted upward and moved somewhat to the left to account for the range and drift of the fired round.

Figure 9:
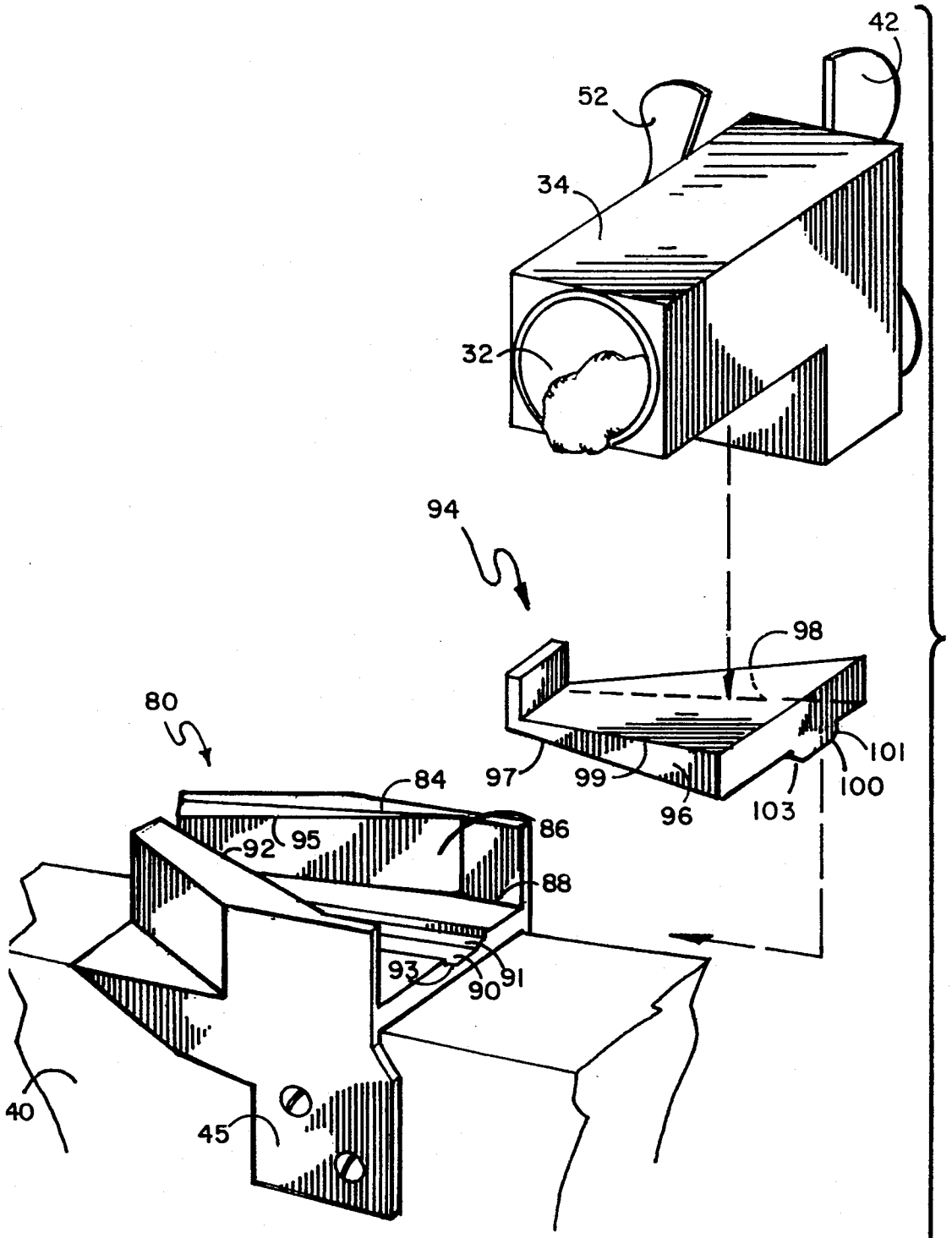
FIG. 9 illustrates the mounting system of the sight mount of this invention.

FIG. 9 illustrates a view of the mounting system of the sight mount of this invention wherein mounting platform 80 is positioned on the top rear of receiver 40 of the gun which can be held thereto by bolts into specifically created bolt receipt apertures not seen in this view. Mounting platform 80 can have saddle mounts with downward engaging members on each side, such as side member 45, which side members straddle each side of receiver 40. Mounting platform 80 has a generally triangular-shaped receiver portion with a first angular side 86 and a second angular side 92 with each angular side having a top, such as top 84 of first angular side 86, forming a channel on each side, each side of which gets narrower near the front along its angled top, such as angled top 95. Within bottom 88 of mounting platform 80 is defined a central groove 90 with angled sides 91 and 93, which groove is aligned with the barrel of the gun. A triangular insert member 94 is mounted on the base of shaft housing 34. Insert member 94 becomes narrower near its front as bottom edge 97 and top edge 99 come closer together. Insert member 94 is a three-dimensional, one-way, male-female dovetail for the sight mount's base attachment. Both mounting platform 80 and insert member 94 are aligned by sets of hex bolts which are torqued in sequence to form controlled indexing surfaces. The bolts extend through oversized holes in the receiver to allow adjustment of both mounting platform 80 and insert member 94 for both pitch and azimuth direction. Triangular insert member 94 on the sight mount has first insert angular side 98 and second insert angular side 96 which each become narrower near the front, such as along bottom edge 97 and top edge 99 of second angular side 96. First and second insert angular sides 98 and 96 are received, respectively, within first angular side 86 and second angular side 92 of mounting platform 80. A projection 100 with first and second angled sides also extends along the bottom of triangular insert member 94 which mates into and slides forward within central groove 90 as the three sets of triangular members are mated together which mating produces a secure alignment of the triangular insert member 94 within mounting platform 80. By the use of such a mounting system, repeatable accurate mounting and dismounting can be achieved of the sight mount of this invention. A mount lock 52, as seen in FIG. 7, can be rotated downward in front of a portion of mounting platform 80 into a slot to lock the sight in place as mount lock 52 then prevents withdrawal of insert member 94 from mounting platform 80.

FIG. 10 illustrates a drift comparison chart, showing the drift correction in meters of a projectile using the sight mount of this invention indicated as "NEW DESIGN" for the range of 0–2000 meters and the drift correction of the traditional MK19 iron sight indicated as "MK19 SIGHT" for the range of 0–1,500 meters. Dotted line 100 indicates the drift correction using the sight mount of this invention and dashed line 102 indicates the drift correction using the traditional iron sight mount as compared to table values.

FIG. 11 illustrates a chart showing the barrel elevation angles necessary to achieve various projectile ranges.

Although the present invention has been described with reference to particular embodiments, it will be apparent to those skilled in the art that variations and modifications can be substituted therefor without departing from the principles and spirit of the invention.

We claim:

1. An improved gun sight mount on which is mounted a gun sight for use with a gun having a barrel, said barrel having an axis defined along its length, through which barrel is fired a projectile toward a target, said projectile having increasing drift as its range increases, comprising:

a rotatable shaft member having a shaft axis defined along its length and a first and second end, said shaft member disposed transverse, and at an acute angle selected in accordance to said projectile's drift, to said axis of said gun barrel;

means to rotate said shaft member on its axis to a selected rotational position in registration to the range selected for said projectile to be fired, said means to rotate said shaft member disposed on said first end of said shaft member;

a sight mount platform having a length on which platform said gun sight is mounted, said sight mount platform fixedly mounted on said second end of said shaft member, said sight mount platform having an axis defined along its length, said platform axis at zero range disposed offset from, and parallel to, said axis of said barrel, said sight mount platform concurrently being disposed on said rotatable shaft member at the same acute angle as said shaft is disposed to said barrel, said angle selected in accordance to said projectile drift; and means to adjust said sight for the drift of said projectile at said selected range by said rotation of said shaft member to a non-zero range selected position by moving said sight mount platform's axis by the rotation of said shaft to be aimed downward and outward from said barrel to a position out of parallel alignment with said axis of said barrel relative to said projectile's drift whereby when said gun sight is aimed toward said target, such action lifting said gun barrel to the required elevation for said selected range while at the same time laterally offsetting said barrel from direct alignment with said target by an angle corresponding to the projectile's drift.

2. The sight mount of claim 1 wherein said angle of said shaft member to said axis of said barrel is approximately 70 degrees.

3. The sight mount of claim 1 wherein said means to rotate said shaft member includes:

a cam follower mounted on said first end of said shaft member;

a cam shaft having a first and second end;

an eccentric cam mounted on said second end of said cam shaft;

a handle mounted on said first end of said cam shaft;

said eccentric cam being rotated on said cam shaft upon movement of said handle, said eccentric cam contacting said cam follower and, when rotated, causing rotation of said cam follower and attached shaft member.

4. The sight mount of claim 3 further including range indication indicia visibly disposed relative to said handle, allowing rotation of said handle to a position corresponding to a selected of said range indication indicia.

5. The sight mount of claim 4 further including selectively engageable and disengageable locking means to prevent rotation, when engaged, of said shaft member after the selected range has been set.

6. The sight mount of claim 4 further including tactile indication means for sensing said selected range setting when rotating said handle.

7. The sight mount of claim 6 wherein said tactile indication means include:

a wheel member having a periphery, said wheel member having a plurality of detents defined on its periphery, said wheel member mounted and rotated on said cam shaft; and a plunger member resiliently urged against said wheel periphery to be pushed into selected of said detents with a clicking-type action.

8. The sight mount of claim 4 further including counter-urging means to apply resistance to the downward rotation of said sight mount platform.

9. The sight mount of claim 8 wherein said counter-urging means include a spring member having first and second ends, said spring member attached at its first end to said shaft member with its second end fixed in position, said spring member positioned to be resistant to the axial rotation of said shaft member.

10. The sight mount of claim 4 wherein said sight mount platform includes a built-in gun sight.

11. The sight mount of claim 10 wherein said built-in gun sight is a hollow, tubular opening defined in said sight mount platform extending parallel to said axis of said sight mount platform.

12. The sight mount of claim 10 wherein said sight mount platform further includes a plurality of means to mount gun sights thereon.

* * * * *